US005569085A

United States Patent [19]

Igarashi et al.

[11] Patent Number: 5,569,085

[45] Date of Patent: Oct. 29, 1996

[54] GUN GAME MACHINE HAVING A SLIDING GUN BARREL COVER FOR SIMULATING THE IMPACT OF A FIRED GUN

[75] Inventors: Hiroshi Igarashi; Azuma Mochizuki; Yoshitaka Kajima; Toshiya Ohara; Hideki Inoue; Shigeki Tohyama, all of Tokyo, Japan

[73] Assignee: Namco Limited, Tokyo, Japan

[21] Appl. No.: 504,353

[22] Filed: Jul. 19, 1995

[30] Foreign Application Priority Data

Jul. 29, 1994 [JP] Japan ..... 6-197952

[51] Int. Cl.[6] ..... A63F 9/02; F41J 5/02

[52] U.S. Cl. ..... 463/49; 463/50; 463/51; 434/18; 434/20; 434/21; 434/22; 446/473

[58] Field of Search ..... 463/49, 50, 51, 463/52; 434/18, 20, 21, 22; 446/473, 405, 406, 407

[56] References Cited

U.S. PATENT DOCUMENTS 2,529,709 11/1950 Sigg ..... 446/407
2,741,872 4/1956 Sigg ..... 446/406
2,770,916 11/1956 Sigg ..... 446/407
4,336,018 6/1982 Marshall et al. ..... 434/22
4,619,616 10/1986 Clarke ..... 434/22

*Primary Examiner*—Benjamin H. Layno
*Attorney, Agent, or Firm*—Burns, Doane, Swecker & Mathis, LLP

[57] ABSTRACT

A gun game machine wherein the player can hold a model gun in the hand away from an machine casing. This gun game machine comprises a bullet hitting optical detection unit installed in the model gun for detecting a simulated bullet hitting position, a sliding cover provided on an exposed outward portion of the gunbarrel of the model gun and slidable in the longitudinal direction of the gunbarrel section, and a cover driving means for instantaneously moving the sliding cover at high speed. The model gun and the game machine casing may be coupled to each other by means of a flexible cable containing electric conductors. The sliding cover makes a long reciprocating motion similar to the so-called blow-back movement of an actual gun, so that the player can feel a similar reaction or impact corresponding to the firing of the actual gun. This simulated firing operation also serves to attract spectators to the game.

9 Claims, 6 Drawing Sheets

GUN GAME MACHINE HAVING A SLIDING GUN BARREL COVER FOR SIMULATING THE IMPACT OF A FIRED GUN

BACKGROUND OF THE INVENTION

1. Field of the Invention

The present invention relates to a gun game machine wherein a simulated shot to a target is made using a model gun, and more particularly a gun game machine wherein a player can hold the model gun in the hand away from a machine casing to play.

2. Related Art

Heretofore, there have been known different types of gun game machines using a model gun. For example, in some types of gun game machines, a game is played using the model gun rotatably fixed to a machine casing, and in another types of gun game machines, the player grips in the hand the model gun coupled to the machine casing through a flexible cable to play the game. Among these different gun game machines, those using the model gun coupled to the machine casing through the flexible cable is particularly advantageous in that the model gun is freely transported within the area allowed by the cable and they are widely employed as video game machines, etc.

However, the model guns used for the conventional gun game machines have imitated an actual gun only in terms of appearance and don't comprise almost moving parts which would operate just like parts of the actual gun. Therefore, when the player made a simulated shooting action, the player could not feel reaction or impact so as to impede to direct a realistic game. Moreover, they have been insufficient to attract those who are watching the simulated shooting action of the player.

SUMMERY OF THE INVENTION

The present invention intends to overcome the drawbacks mentioned hereinbefore and to provide, in a gun game machine wherein a player can take a model gun out from its machine casing to play the game, the player can feel a reaction or an impact similar to that in the actual gun shooting action and moreover to attract those who are watching the simulated shooting action in the game.

To accomplish the above-mentioned objects, the gun game machine according to the present invention wherein the player can take the model gun out from its machine casing comprises a bullet hitting detection optical unit disposed in the model gun for detecting a simulated bullet hitting position, a sliding cover disposed in a state exposed outward on a gunbarrel section of the model gun and slidable in the longitudinal direction of the gunbarrel section, and a cover driving means for moving instantaneously the sliding cover at high speed.

The player grips the model gun in the hand to play the game. When the player pulls a trigger of the model gun, the cover driving means functions to slide the sliding cover rearward instantaneously at high speed. This movement of the sliding cover is similar to so-called blowback movement of the actual gun and permits the player to feel a similar reaction or an impact corresponding to the simulated shooting operation. This simulated blow-back operation also allows to effectively attract observers of the game.

The model gun can usually be coupled to the machine casing by means of a flexible cable containing electric conductors. It is also possible to eliminate the flexible cable connecting the model gun to the machine casing by sending signals between the model gun and the game machine body through wireless communication.

In the gun game machine, a bullet hitting optical detection system is necessary for determining the virtual bullet hitting position at which the model gun aims, that is, determining where the simulated bullet hitting position is. The bullet hitting optical detection unit disposed in the model gun becomes a part constituting the bullet hitting optical detection system. The bullet hitting detection optical unit may be composed by, for instance, an optical unit using a light receiving element or an optical unit using a light emitting element. When a light receiving element is disposed in the model gun, the direction of the light receiving element, namely the direction on which the muzzle of the model gun is trained is detected by receiving the light emitted from the target side with this light receiving element. On the other hand, when the light emitting element is disposed in the model gun, the direction on which the muzzle is trained is detected by determining where the light from this light emitting element is detected on the target side.

Targets can be displayed as an image on a CRT monitor. In this case, the point at which the model gun is trained, namely the simulated bullet hitting position may be detected by disposing the bullet hitting optical detection unit comprising the light receiving element in the model gun which detects the light emitting luminescent spot on the CRT monitor. This detection method permits to detect the simulated bullet hitting position with extremely high precision compared to the detection method wherein the light emitting element is installed in the model gun. When the sliding cover is mounted on such a high precision measuring system, the reaction brought by a movement of the sliding cover may affect the aiming of the model gun considerably. In other words, the shooting ability of the player may be reflected strictly in the game and thus the player can concentrate on the game.

To protect the player by avoiding the impact of the player on the moving sliding cover, it is preferable to provide the gunbarrel with protective member protruding rearward from the rear end position of the gunbarrel section. This permits to ensure the security of the player. In this case, the protective protruding member is preferably formed imitating the striker section of a real gun. By doing this, the security can be ensured preserving the reality of the game and a feeling of a real gun operation.

When the model gun comprises an upper gunbarrel section including a simulated muzzle section and a lower gunbarrel section positioned between the upper gunbarrel and a grip section, the sliding cover can be disposed on the upper gunbarrel and the bullet hitting detection optical unit for detecting the simulated bullet hitting position can be contained in the lower gunbarrel section. Thus, when the sliding cover and the optical unit are disposed separately, the sliding cover can be constructed with sufficiently large dimensions independently of the size of the optical unit. Therefore, a sufficiently large reaction may be afforded to the player and moreover, the appearance will be well. Additionally, a larger space may be ensured for disposing the optical unit so as to permit to enlarge the collector lens diameter. An enlarged collector lens increases the intensity of the light converged on a light receiving sensor so that a high precision simulated bullet hitting position determination may be realized.

The cover driving means for moving the sliding cover is not limited to a certain construction. In a preferred construction, however, it is preferably composed of an electromagnetic solenoid, and a movable member which is driven by the electromagnetic solenoid and guided by a guide means to move rectilinearly and reciprocally. If this composition is adopted, the sliding cover is mounted fixedly to this movable member. Thus constructed, this simple construction allows the sliding cover to make a smooth reciprocation motion instantaneously at high speed.

The appearance and shape of the sliding cover and its periphery are not limited to a specific configuration, and it is advantageously composed as follows. That is, a simulated muzzle section is disposed at the forward end of the gunbarrel section, the protective protruding member is disposed at the rear end of the gun barrel section in a manner of protruding backward and the sliding cover is disposed between the simulated muzzle section and the protective protruding member in a way to cover substantially all the gunbarrel section. This composition permits to increase the size of the sliding cover as large as possible so that it can afford the player a large reaction or impact and, moreover, attract observers effectively to the game. Additionally, as its aspect and shape are similar to those of a real gun, the player can enjoy a very similar game.

DETAILED DESCRIPTION OF THE PREFERRED EMBODIMENT (Embodiment 1)

Figure 1:
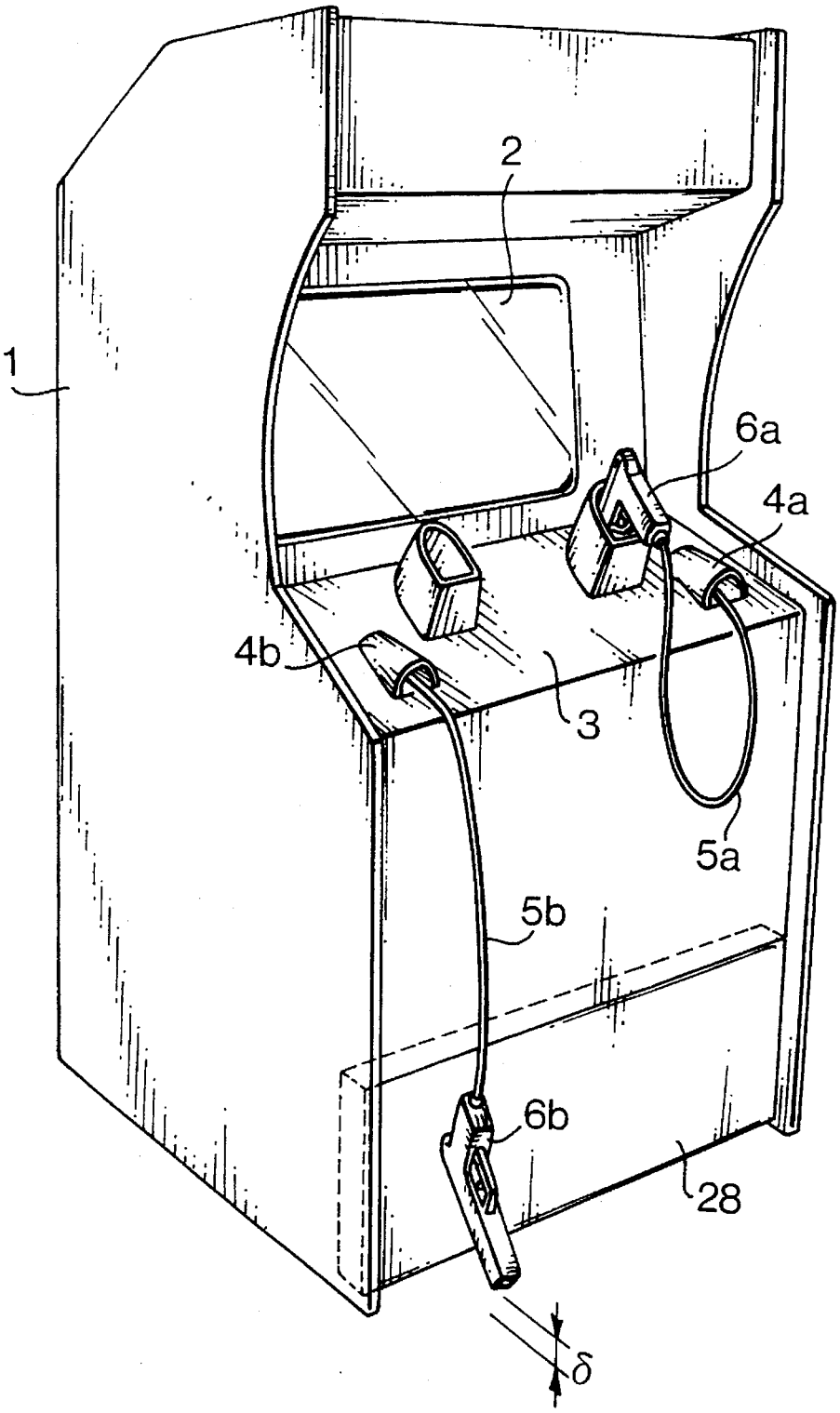
FIG. 1 is a perspective view of an embodiment of the gun game machine according to the present invention.

FIG. 1 illustrates an embodiment of the gun game machine according to the present invention. This gun game machine, a so-called video game machine, includes a CRT monitor 2 as the display device in a machine casing 1. Cable exits 4*a* and 4*b* are disposed on the operation section 3 arranged at the front of the machine casing 1. Cables 5*a* and 5*b* are respectively extend from these cable exits. Model guns 6*a* and 6*b* are coupled respectively to the ends of the cables 5*a* and 5*b*. A resilient member 28 made of rubber or plastic having impact absorbing properties is installed at the lower part of the machine casing 1.

Figure 2:
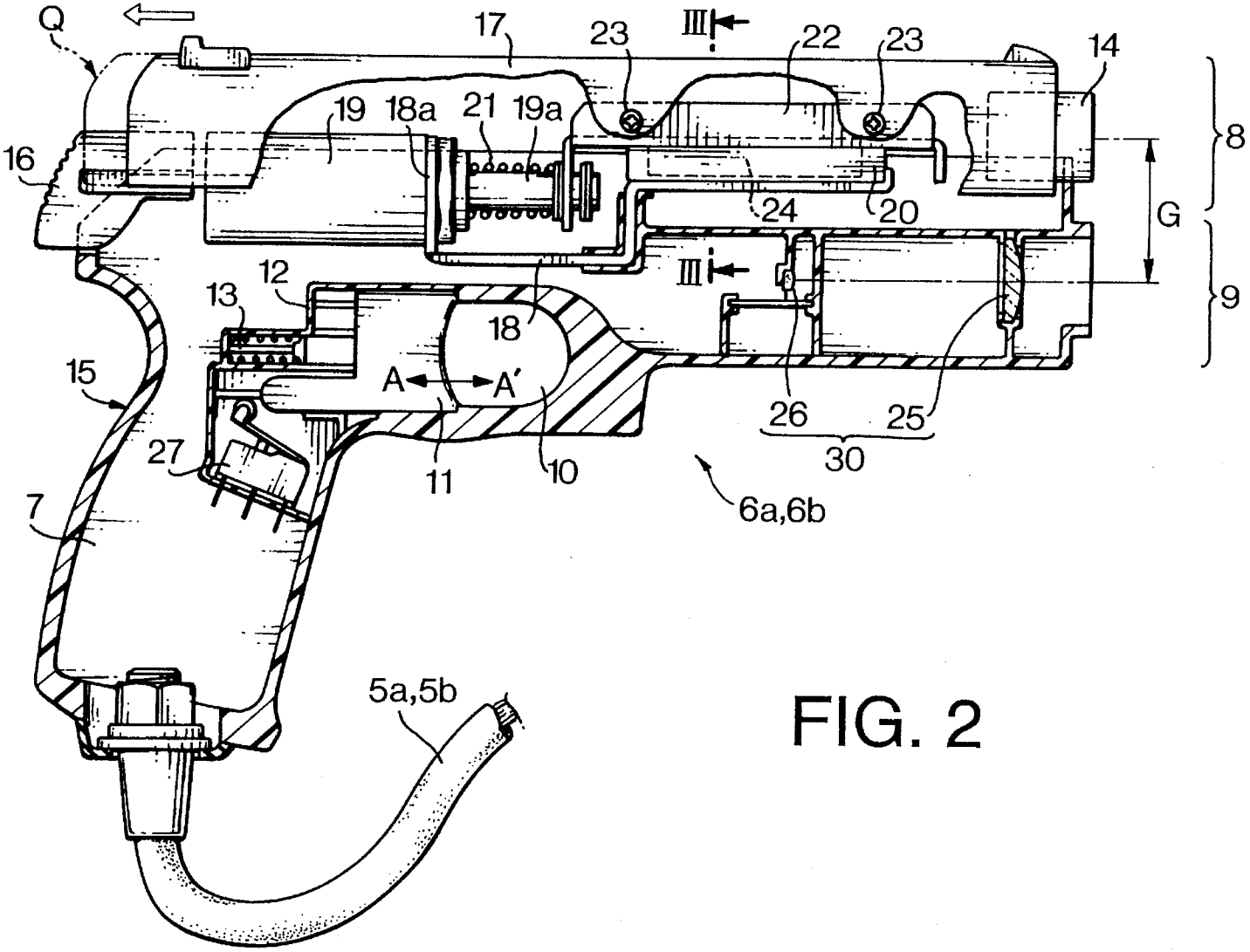
FIG. 2 is a cross section of an example of the model gun.

As shown in FIG. 2, the model guns 6*a* and 6*b* comprise a grip section 7 to be held by the player, an upper gunbarrel section 8 resembling the part from which bullets are fired and a lower gunbarrel section 9. The grip 7 and the lower gunbarrel section 9 are formed integral with a gun body section 15. The upper gunbarrel section 8 comprises a simulated muzzle section 14 mounted fixedly to the right top of the gun body section 15, a simulated striker section 16 mounted fixedly to the left top of the gun body section 15 for serving as protective protruding member, and a sliding cover 17 disposed covering substantially over the upper gunbarrel section 8 between the simulated muzzle section 14 and the simulated striker section 16.

An opening section 10 is formed in the gun body section 15 between the grip section 7 and the lower gun barrel section 9 for installing a finger of the player and a trigger 11 is disposed in the opening section. This trigger 11 slidably moves in parallel as shown by the arrows A—A' all the way guided by a guide wall 12 installed in the grip section 7. The trigger 11 is normally biased in the direction of the arrow A', namely to the right in the drawing, by the spring force of a compression spring 13. When the trigger 11 is pulled to the left in the drawing (namely the direction of the arrow A) against the spring force of the spring 13, an actuator of a microswitch 27 is pushed down to activate the microswitch 27.

Figure 3:
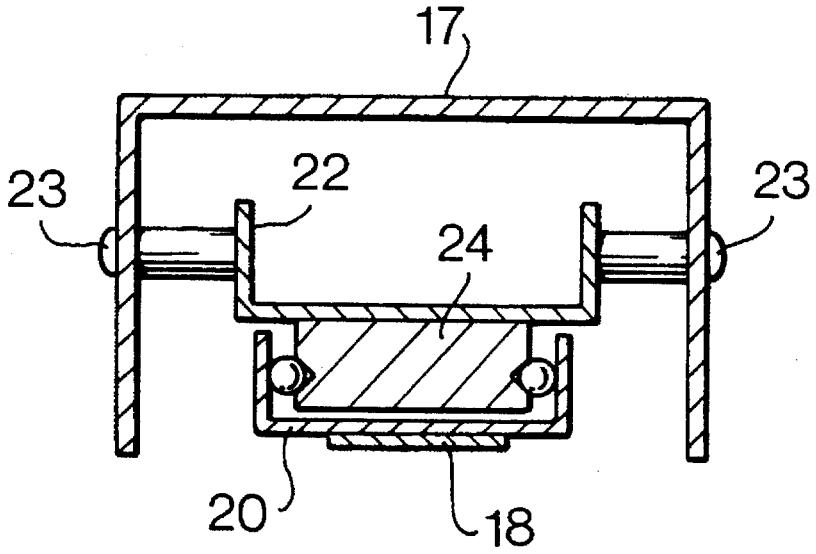
FIG. 3 is a cross sectional view in accordance with the line III—III of FIG. 2.

An attachment 18 of a curbed form is fixed immovably at the middle center of the gun body 15. An electromagnetic solenoid 19 is fixed by a screw or other fixing members to a left upstanding section 18*a* of the attachment 18. A guide groove 20 is attached fixedly to the right of the attachment 18. The section of the guide groove 20 is formed substantially in a "U" shape as shown in FIG. 3.

Referring to FIG. 2, a compression spring 21 is disposed around a plunger 19*a*of the solenoid 19 and a bracket is loosely fitted with the end of the plunger 19*a*. A sliding cover 17 is fixed to the side of the bracket 22 with screws 23 and 23. Moreover, a slider 24 for sliding through the guide groove 20 is fixed by a screw or other fixing members to the bottom of the bracket 22 as shown in FIG. 3.

A bullet hitting optical detection unit 30 including a collector lens 25 and a photosensor 26 is contained in the lower gunbarrel 9. This optical unit is employed to detect the simulated bullet hitting position on the CRT monitor 2 (FIG. 1) when the trigger 11 is pulled to the left in FIG. 2 as the player holds the model guns 6*a* and/or 6*b* and trains the simulated muzzle 14 at the CRT monitor 2. To be more specific, a coordinate position on the CRT monitor 2 at which the simulated muzzle 14 is trained is determined by detecting with the photosensor 26 a raster scan luminescence on the CRT monitor 2 when the trigger 11 is pulled. As the photosensor 26 is installed at a lower location slightly remote from the simulated muzzle 14, the simulated bullet hitting position detected by the photosensor 26 does not exactly agree with the position at which the simulated muzzle 14 is trained but contains a error corresponding to the distance G. This distance may, however, be compensated by compensating the operating process of the operation circuit for calculating the simulated bullet hitting position based on the output signal of the photosensor 26.

As described above, a sufficiently large size of the sliding cover can be formed independently of the size of the optical unit by separately installing the sliding cover and the optical unit so as to afford the player a sufficiently large reaction and to make the model gun look more attractive. Since the space for the optical system arrangement is enlarged so as to permit the diameter of the collector lens to be increased then a highly precise determination of the simulated bullet hitting position can be obtained by increasing the intensity of the light converging on the photosensor.

Referring to FIG. 2, the cables 5*a* and 5*b* contain respectively signal conductors leading to a microswitch 27, a signal conductor leading to the photosensor 26 and a power supply wire leading to the solenoid 19.

In the gun game machine of this embodiment, a game story is conveniently indicated as an image on the CRT monitor 2 shown in FIG. 1 and the player holds the model guns 6*a* and/or 6*b* in one or both hands to perform a simulation shooting toward the image. In the course of this simulation shooting, if the player pull the trigger 11 in the direction of the arrow A of FIG. 2, the solenoid 19 will be energized instantaneously, for example, for 5/100 seconds, and thus the plunger 19*a* reciprocates instantaneously at high speed. At the same time, the bracket 22 fitted with the plunger 19*a* and the sliding cover 17 fixed to the bracket 22 make a reciprocating motion instantaneously at high speed so as to afford the player an impact due to the shooting reaction. Thus, the player can enjoy a very similar shooting play. Moreover, the backward reciprocating sliding motion of the sliding cover 17 is similar to the blowback motion of a real gun and, as additional effect, attract watchers of this motion in the game.

By the way, in this embodiment, the length of the cables 5*a* and 5*b* each coupling the model guns 6*a* and 6*b* to the machine casing 1 is limited. To be specific, the length of the cable 5*b* is set shorter than the conventional one so that, when the model gun 6*b* is fallen freely, the model gun 6*b* will not touch the floor, as shown in FIG. 1, leaving a convenient distance "δ" between them. Though the figure shows only for the one cable 5*b*, the length of the other cable is set similarly.

Conventionally, since the cables 5*a* and 5*b* are long, the model guns 6*a* and 6*b* may fall out with the floor to receive an important shock. Such a shock should be avoided particularly for the model gun of the present invention containing mechanical components or optical unit inside. As shown in FIG. 2, the player may handle the model gun more easily if the cables 5*a* and 5*b* are coupled to the bottom of the grip 7. In this case, however, when the model guns 6*a* and 6*b* are fallen, the forward end portion of the gunbarrel containing the collector lens 25 or other optical components may hit the floor more often. Such a impact should be avoided because the optical system is made of precision components. Moreover, the impact imparted to the forward end section of the model gun may cause cracking or other damages of the forward end section of the gunbarrel. If those damages are provoked, they will permit unnecessary light to infiltrate into the photosensor 26 and generate noise component so as to decrease the simulated bullet hitting position detection precision. Therefore, the impact to the model gun should be avoided also from this point of view.

Concerning this point, if the cables 5*a* and 5*b* are shortened in order to avoid collision between the model gun and the floor as in this embodiment, a great impact would not be applied to the model gun even when the player drops the model gun by mistake or intentionally. Therefore, this embodiment permits to hold with great security a model gun containing mechanical or optical components inside or the model gun wherein a cable is couple to the bottom of the grip and optical or other precision components are arranged in the forward end section of the gunbarrel or other types of model gun. Moreover, by providing an resilient member 28 at the bottom of the machine casing 1, any impact from the machine casing 1 to the model guns 6*a* and 6*b* would be attenuated so that the model gun could be held more securely. If the cables 5*a* and 5*b* are shortened, it is expected that the free movement range of the model gun will be restricted when the player holds the model guns 6*a* and 6*b* to play a game. In this embodiment, however, since the cables 5*a* and 5*b* extend from the exits 4*a* and 4*b* provided on the top of the operation section 3, the degree of free movement of the model gun will not be so restricted.

Now, referring to FIG. 2, the sliding cover 17 shifts backward with momentum as shown by the dotted line Q when the trigger 11 is pulled, it may hit the face or other parts of the player who is operating the model gun. In this embodiment, however, as the protective protruding member 16 is protruding substantially backward imitating the state of a striker in its horizontal position, the sliding cover 17 would not hit the player even if it moves backward in a way to assure the security. In this case, since the protective protruding member is configured imitating the striker of a real gun, the reality or the presence of a game would not be damaged all the way ensuring a great security.

Figure 4:
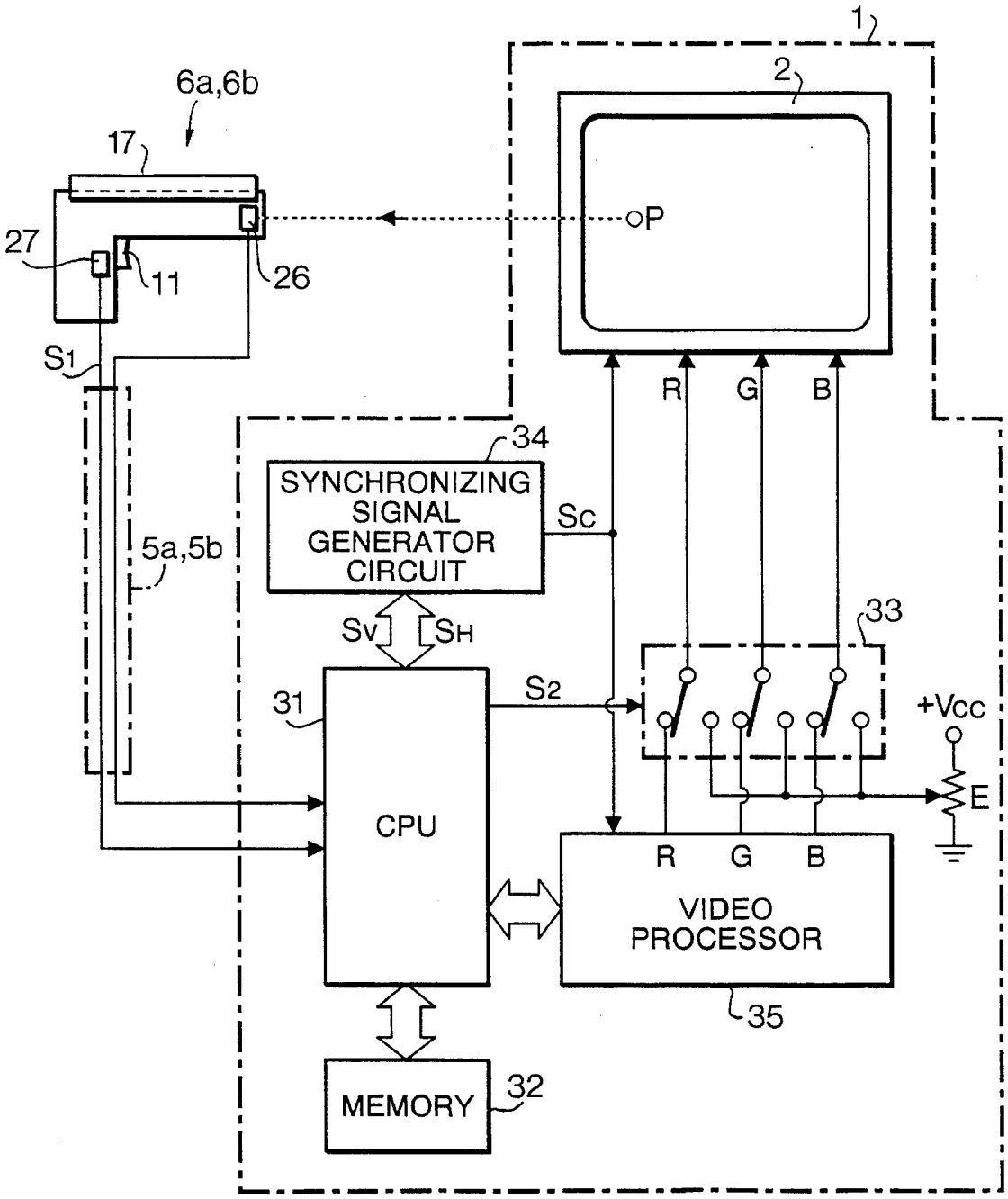
FIG. 4 is a block diagram illustrating the main part of an embodiment of an electric control system for the gun game machine shown in FIG. 1.

FIG. 4 illustrates an example of bullet hitting position detection device for detecting the simulated hitting position of bullets fired by the model gun 6*a* and 6*b*. In this figure, output signal from the photosensor 26 and the microswitch 27 is transmitted to the input port of a CPU (central processing unit) 31 and the CPU 31 control the operation of a switch 33, a synchronizing signal generator circuit 34 and video processor 35 respectively according to the game program stored in a memory 32.

The CPU 31 controls the video processor 35 based on horizontal synchronizing signal $S_H$ and vertical synchronizing signal $S_V$ transmitted from the synchronizing signal generator circuit 34. The video processor 35 generates RGB signal corresponding to the game story synchronizing with combined synchronizing signal Sc from the synchronizing signal generator circuit 34 and the RGB signal are supplied to the video input terminal of the CRT monitor 2 to display a specific game image on the monitor screen. Target images appear in this image with a convenient timing and the player pulls the trigger 11 of the model gun 6*a* and/or 6*b* aiming at this target image. When the trigger 11 is pulled, the microswitch 27 will be activated to transmit a firing signal S1 which is transmitted to the CPU 31. When the CPU 31 receives the firing signal S1, it will emit a switching signal S2 to a switch 33 and the RGB input terminal of the CRT monitor 2 changes over from the video processor 35 to a constant voltage E according to this switching signal S2.

On the monitor 2, a luminescent spot P of constant luminance scans the entire screen by one frame according to the synchronizing signal Sc and by this, a white screen will be displayed instantaneously on this screen. When this white screen is displayed, if the luminescent spot P passes the position on the screen aimed at by the model gun 6*a* and/or 6*b*, this light will be received by the photosensor 26 in the model gun 6*a* and/or 6*b* and a output signal will be generated in the photosensor 26. On the reception of this output signal, the CPU 31 determines the luminescent spot P of which position on the screen of the monitor 2 is detected by the photosensor 26 based on the horizontal synchronizing and the vertical synchronizing signal of that moment. Thus the simulated bullet hitting position is determined by the CPU 31 and if the target image exists at that position, the CPU 31 will perform game operations for telling an on-target impact shots including, for instance, score addition. On the other hand, if the target image does not exist at the simulated bullet hitting position, the CPU 31 will perform game operation for telling of missing the target.

As mentioned above, the simulated bullet hitting position can be detected with high precision by detecting the simulated bullet hitting position based on the luminescence from the CRT monitor 2. When the sliding cover 17 is disposed in such a high precision measuring system, the aiming at the gun model varies substantially by the reaction of the motion of the sliding cover 17. This means that the shooting skill of the player is reflected well on the game and thus the player would be all the more absorbed by the game.

(Embodiment 2)

Figure 5:
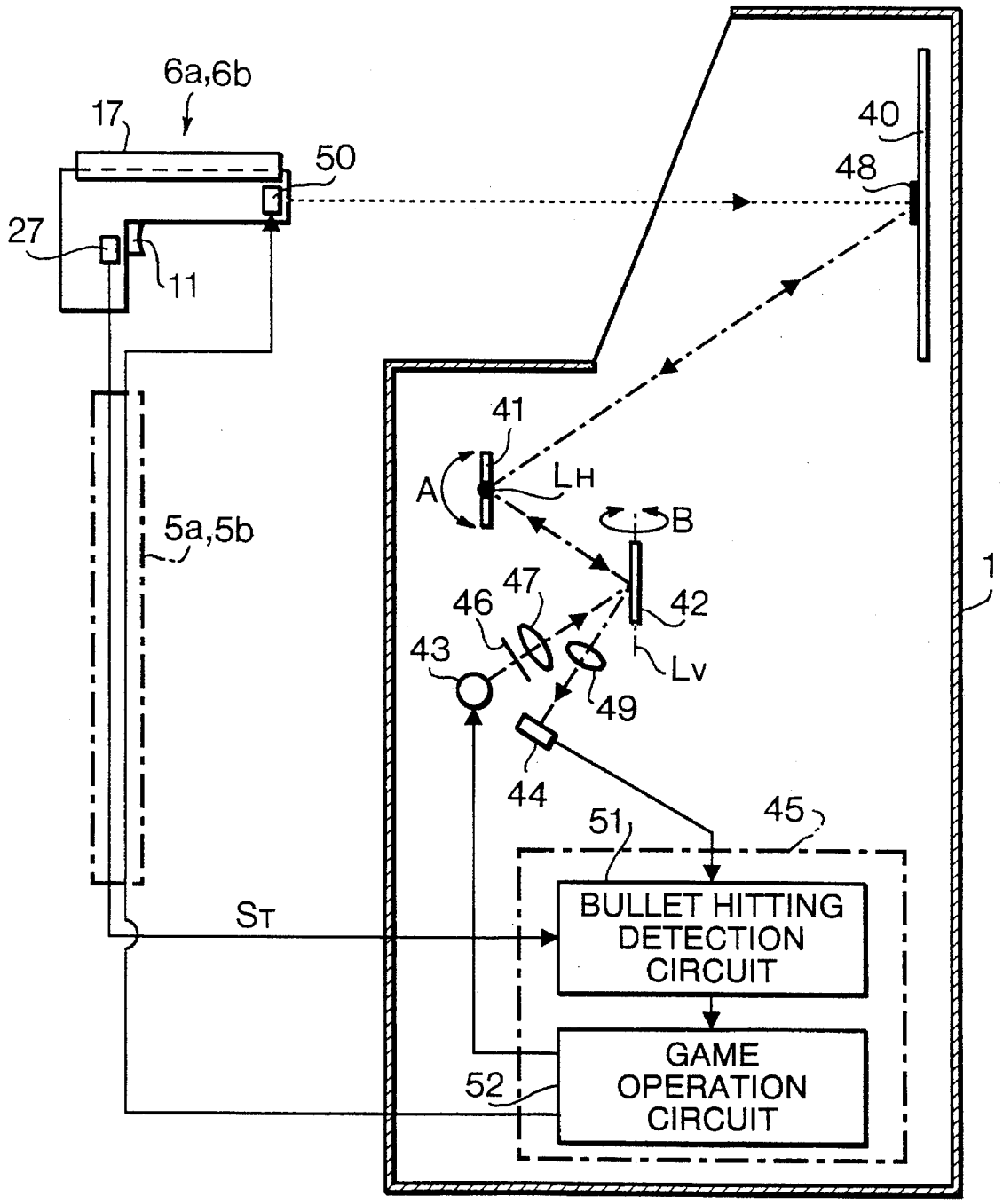
FIG. 5 is a cross sectional view showing another embodiment of the gun game machine of the present invention.

FIG. 5 illustrates another embodiment of the gun game machine according to the present invention. This embodiment is different from the prior embodiment shown in FIG. 4 mainly in that a screen is used as a means for displaying targets in place of the CRT monitor and that a light emitting element is used in place of the photosensor in the bullet hitting detection optical unit to be disposed in the model gun.

Figure 7:
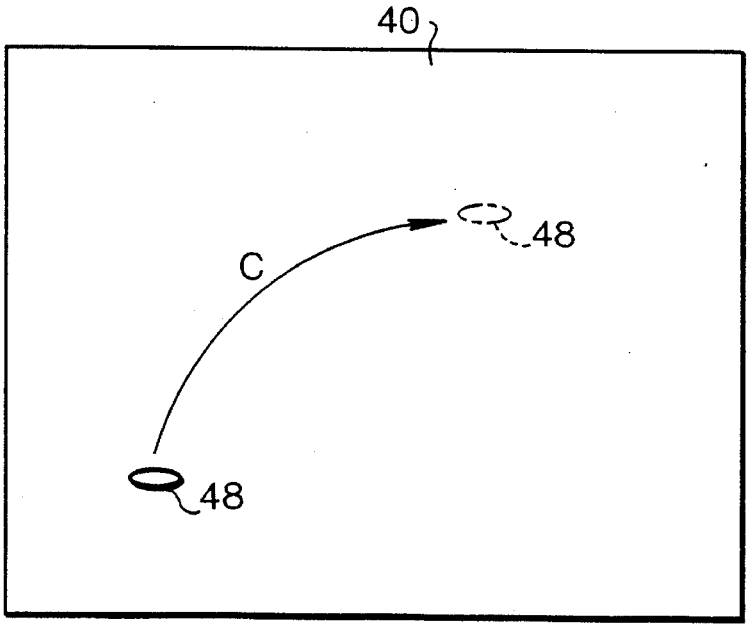
FIG. 7 illustrates a target image employed in the embodiment shown in FIG. 5.

In FIG. 5, a light emitting element 50 is disposed in the model guns 6*a* and 6*b* for constituting the bullet hitting detection optical unit. Additionally, a screen 40, a horizontal rotation mirror 41, a vertical rotation mirror 42, a lamp 43, a light receiving element 44 and a control device 45 are disposed respectively in a machine casing 1. The horizontal rotation mirror 41 pivots on the horizontal axis $L_H$ as shown by the arrow A and the vertical rotation mirror 42 pivots on the vertical axis $L_V$ as shown by the arrow B. A shield 46 and a optical system 47 are disposed between the lamp 43 and the vertical rotation mirror 42. Light emitted from the lamp 43 passes through the shield 46 and the optical system 47, reflected on the vertical rotation mirror 42 and the horizontal rotation mirror 41 and attains to the screen 40. Then a target image 48 is displayed on the screen 40, as shown in FIG. 7, according to the translucent pattern formed on the shield 46. Moreover, by pivoting the vertical rotation mirror 42 and the horizontal rotation mirror 41 on respective axis, the target image 48 may be moved on the screen 40 as shown by the arrow C in FIG. 7. A reference numeral 49 shows an optical system disposed ahead of the light receiving element 44.

Figure 6:
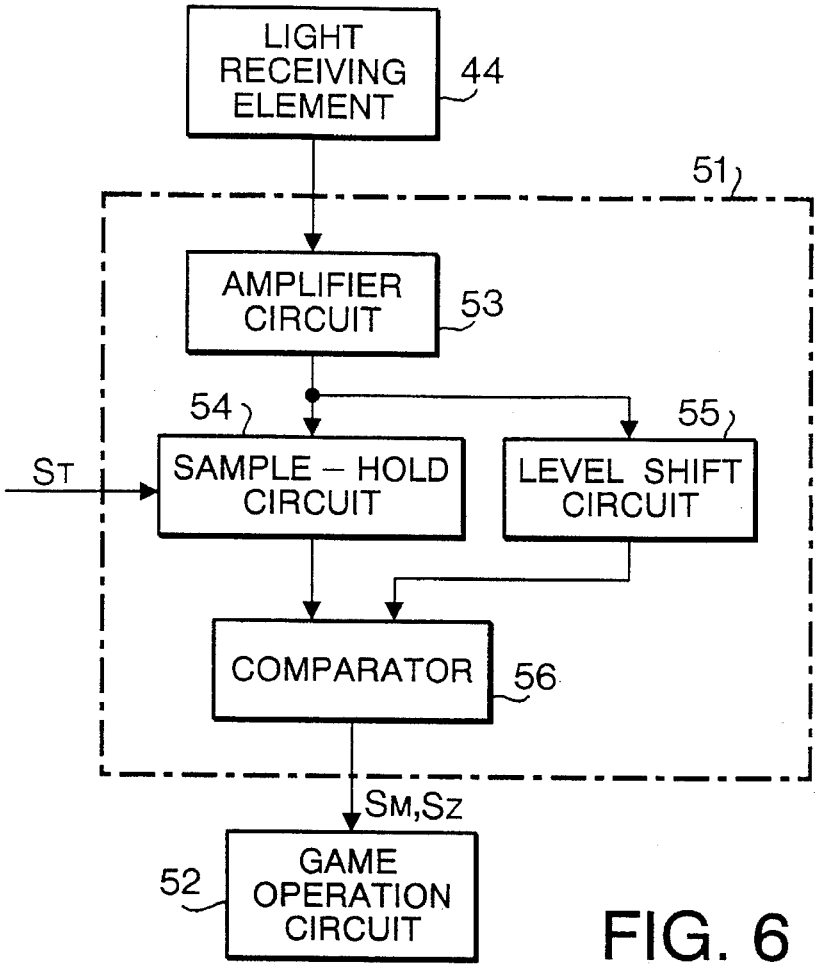
FIG. 6 is a block diagram illustrating the main part of an embodiment of an electric control system for the gun game machine shown in FIG. 5.

The control device 45 includes a bullet hitting detection circuit 51 for determining the simulated bullet hitting position of the model gun 6*a* and 6*b* and a game operation circuit 52 for controlling the entire game. The bullet hitting detection circuit 51 comprises, as shown in FIG. 6 for example, an amplifier circuit 53 for amplifying the output signal of the light receiving element 44, a sample-hold circuit 54 for receiving the output signal from the amplifier circuit 53, a level shift circuit 55 for modifying the level of the output signal from the amplifier circuit 53, and a comparator 56 for producing a hit signal $S_M$ or a miss hit signal $S_Z$ by comparing the output from the sample-hold circuit 54 and the output signal from the level shift circuit 55. When the sample-hold circuit 54 receives a firing signal $S_T$ emitted from a microswitch 27 attached to the trigger 11, it holds once the output signal of the amplifier circuit 53 of that moment and then outputs it.

As the gun game machine of this embodiment is composed as mentioned above, when the game starts, a target image 48 appears on the screen at a convenient timing and moves over. The player pulls the trigger 11 of the model gun 6*a* and/or 6*b* aiming at this target image 48. When the trigger 11 is pulled, if the aim of the model gun 6*a* and 6*b* does not accurately agree with the target image 48, that is, if it goes wide of the target, the light from the light emitting element 50 will not be superposed on the target image 48. Therefore, the intensity of the light reflected from the target image 48 does not change before and after the pull of the trigger 11 and, thus in FIG. 6, no substantial change will occur in respective outputs of the sample-hold circuit 54 and the level shift circuit 55 to be applied to the both input terminals of the comparator 56. As a consequence, a miss hit signal $S_Z$ will be output from the output terminal of the comparator 56.

When the trigger 11 is pulled, if the aim of the model guns 6*a* and/or 6*b* accurately agrees with the target image 48, that is, if it tells on the target, the light from the light emitting element 50 will superposed on the target image 48 and thus, the intensity of the light reflected from the target image 48 changes remarkably before and after the pull of the trigger 11. Consequently, a substantial change of difference between the output of the sample-hold circuit 54 and the output of the level shift circuit 55 will occur and then, a hit signal $S_M$ will be emitted from the comparator 56. Receiving this hit signal $S_M$, the game operation circuit 52 executes the predetermined operation for displaying an on-target impact.

As mentioned above, the present invention may be applied to the case wherein a target displaying device other than the CRT monitor is employed or wherein a simulated bullet hitting position detecting device of the type emitting light from a gun model.

(Other embodiments)

The present invention has been described hereinbefore referring to the preferred embodiments, but it should be noted that the present invention is not limited to those embodiments but different modifications may be made without departing from the technical scope of the present invention as defined in the appended claims. For example, in the embodiment shown in FIG. 4 and FIG. 5, signals are transmitted between the main body of the game machine and the model gun 6*a* and 6*b* through the cables 5*a* and 5*b* connecting the machine casing 1 and the model guns. However, the cables may be eliminated by transmitting signal between them through radio communication, including infrared light communication, etc.

Moreover, the present invention is not limited to video game machines but includes those gun game machines aiming at an actual moving object. Specifically, the present invention may be applied to a gun game machine in which targets are made to imitate a human being, an animal, etc. and are adapted to move up and down or right and left. On a part of each targets corresponding to the heart of the human being, etc., a photosensor or a light emitting element is located. The player shoots the moving targets aiming the part corresponding to the heart.

Moreover, the present invention may be applied to a gun game machine which comprises a path through which the player moves and a plurality of actual targets placed along the path. In this game machine, the player shoots the targets one after another while moving along the path.

Also, the machine casing shown in FIG. 1 is nothing but an example and its configuration may take any other forms. The model gun shown in FIG. 2 is also nothing but an example, so its configuration and structure may be modified differently without departing the technical scope defined in the appended claims.

Also, the present invention may be applied to a gun game machine for home use and to a gun game machine for business use as well.

What is claimed is:

1. A gun game machine wherein a model gun is coupled to an machine casing by means of a flexible cable and a player can hold said model gun in the hand away from said machine casing, comprising:

a bullet hitting optical detection unit provided in said model gun for detecting a simulated bullet hitting position;

a sliding cover provided on an exposed outward portion of a gunbarrel section of said model gun and slidable in the longitudinal direction of said gunbarrel section; and a cover driving means for instantaneously moving said sliding cover at high speed.

2. A gun game machine as claimed in claim 1, wherein a protective member protruding rearward from the rear end position of said gunbarrel section is provided.

3. A gun game machine as claimed in claim 2, wherein the protective member is formed imitating a striker section of a real gun.

4. A gun game machine as claimed in claim 1, further comprising an upper gunbarrel section including a simulated muzzle section and a lower gunbarrel section positioned between said upper gunbarrel and a grip section, wherein said sliding cover is installed on said upper gunbarrel section and said bullet hitting optical detection unit is contained in said lower gunbarrel section.

5. A gun game machine as claimed in claim 1, wherein said cover driving means comprises an electromagnetic solenoid and a movable member driven by said electromagnetic solenoid to move reciprocally being guided by a guide means and wherein said sliding cover is mounted fixedly to said movable member.

6. A gun game machine as claimed in claim 1, further comprising a simulated muzzle section disposed at the forward end of said gunbarrel section, a protective protruding member disposed at the rear end of said gun barrel section for protruding backward and a sliding cover disposed between said simulated muzzle section and said protective protruding member so as to cover substantially all said gunbarrel section.

7. A gun game machine as claimed in claim 1, further comprising a CRT monitor for displaying targets on image and wherein said bullet hitting detection optical unit includes a photosensor for receiving the light emitted from said CRT monitor.

8. A gun game machine wherein a player can grip a model gun in the hand away from a machine casing, comprising:

a bullet hitting detection optical unit disposed in said model gun for detecting the simulated bullet hitting position;

a sliding cover provided on an exposed outward portion of a gunbarrel section of said model gun and slidable in the longitudinal direction of said gunbarrel section; and a cover driving means for instantaneously moving said sliding cover at high speed.

9. A gun game machine as claimed in claim 8, further comprising an upper gunbarrel section including a simulated muzzle section and a lower gunbarrel section positioned between said upper gunbarrel and a grip section, wherein said sliding cover is disposed on said upper gunbarrel and said bullet hitting optical detection unit is contained in said lower gunbarrel section.

* * * * *